United States Patent [19]

Koide et al.

[11] 4,337,599

[45] Jul. 6, 1982

[54] METHOD OF SHOULDER GRINDING

[75] Inventors: Tsuyoshi Koide, Toyota; Yasuo Suzuki, Kariya, both of Japan

[73] Assignee: Toyoda Koki Kabushiki Kaisha, Kariya, Japan

[21] Appl. No.: 136,479

[22] Filed: Apr. 2, 1980

[30] Foreign Application Priority Data

Apr. 3, 1979 [JP] Japan ..... 54-40550
Apr. 10, 1979 [JP] Japan ..... 54-43929

[51] Int. Cl.[3] ..... B24B 1/00

[52] U.S. Cl. ..... 51/289 R; 51/165.87; 51/326

[58] Field of Search ..... 51/105 R, 105 SP, 165 R, 51/165.8, 165.87, 165.92, 289 R, 326, 327

[56] References Cited

U.S. PATENT DOCUMENTS 2,855,391 10/1960 Fred ..... 51/165 R
3,818,642 6/1974 Seidel ..... 51/165.8
3,919,614 11/1975 Wespi ..... 51/165 R X
4,115,958 9/1978 Englander et al. ..... 51/289 R
4,179,854 12/1979 Munekata et al. ..... 51/105 SP X
4,219,972 9/1980 Ota et al. ..... 51/165.87 X

*Primary Examiner*—James G. Smith
*Attorney, Agent, or Firm*—Oblon, Fisher, Spivak, McClelland & Maier

[57] ABSTRACT

A method of grinding a shoulder portion of a workpiece by a grinding wheel whose edge surface is smaller in width than the shoulder portion of the workpiece. The workpiece is rotated about a first axis and the grinding wheel is rotated about a second axis extending at an acute angle to the first axis. The rotating grinding wheel and the rotating workpiece are first relatively moved to engage the edge surface of the grinding wheel with the radially inner portion of the shoulder portion. The rotating grinding wheel and the rotating workpiece are then relatively moved to move the edge surface of the grinding wheel in a direction substantially perpendicular to and away from the first axis to grind the shoulder portion from the radially inner portion to the radially outer portion thereof by the first grinding surface of the grinding wheel.

4 Claims, 15 Drawing Figures

PRIOR ART

METHOD OF SHOULDER GRINDING

BACKGROUND OF THE INVENTION

1. Field of the Invention

The present invention relates to a method of grinding a shoulder portion adjacent to a cylindrical portion of a workpiece by a grinding wheel whose edge surface is smaller in width than the shoulder portion of the workpiece.

2. Description of the Prior Art

In a conventional method of grinding a shoulder portion adjacent and perpendicular to a cylindrical portion of a workpiece by a grinding wheel whose edge surface is smaller in width than the shoulder portion, as shown in FIG. 1, a grinding wheel G is first moved inwardly toward the axis Ow of rotation of a workpiece W along a path 10 extending at an acute angle to the axis Ow of the workpiece W to grind a radially outer portion of the shoulder portion Wb of the workpiece W by the edge surface Gb of the grinding wheel G, and the workpiece W is then moved axially to separate the shoulder portion Wb thereof from the edge surface Gb of the grinding wheel G through a predetermined distance. These steps are repeated to grind the shoulder portion Wb from the radially outer portion to the radially inner portion. According to this method, each time the grinding wheel G is moved along the path 10 against the shoulder portion Wb, only the edge surface Gb around the intersection P between the edge surface Gb and the face surface Ga is applied with a grinding resistance. Accordingly, only the edge surface Gb around the intersection P is worn out and made dull during its repeated use, so that it is difficult to accurately grind the shoulder portion Wb, particularly the corner portion R between the shoulder portion Wb and the cylindrical portion Wa.

In particular, when the grinding wheel is made of expensive cubic boron nitride and the like, the width of the edge surface Gb is made relatively small in order to increase cost efficiency of the grinding wheel. Accordingly, it is unavoidable for the grinding wheel to be partially worn out and made dull around the intersection between the edge surface and the face surface, which thus results in decreasing the grinding accuracy.

SUMMARY OF THE INVENTION

It is, therefore, an object of the present invention to provide an improved method of grinding a shoulder portion of a workpiece without making an edge surface around the intersection between the edge surface and a face surface of the grinding wheel to be worn out and dull.

Another object of the present invention is to provide an improved method of grinding a shoulder portion of a workpiece, of the character set forth above, wherein the edge surface of the grinding wheel is first engaged with the radially inner portion of the shoulder portion and then moved in a direction substantially perpendicular to and away from the axis of the workpiece to grind the shoulder portion from the radially inner portion to the radially outer portion thereof.

Briefly, according to the present invention, these and other objects are achieved by providing a method of grinding a shoulder portion of a workpiece, as mentioned below. The workpiece is rotated about a first axis. There is provided a grinding wheel having first surface whose width is smaller than the shoulder portion of the workpiece for use in grinding the shoulder portion. The grinding wheel is rotated about a second axis extending at an acute angle to the first axis. First relative movement is effected between the rotating grinding wheel and the rotating workpiece to engage the first surface of the grinding wheel with the radially inner portion of the shoulder portion. Second relative movement is then effected between the rotating grinding wheel and the rotating workpiece to move the first grinding surface of the grinding wheel in a direction substantially perpendicular to and away from the first axis to grind the shoulder portion from the radially inner portion to the radially outer portion thereof by the first grinding surface of the grinding wheel.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENTS

Figure 1:
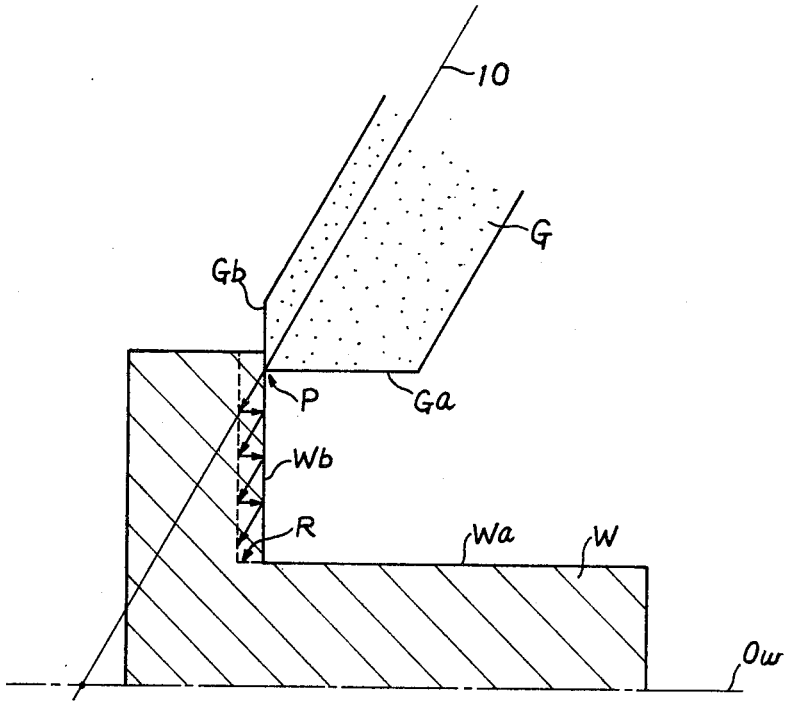
FIG. 1 shows a conventional method of grinding a shoulder portion of a workpiece.
Figure 2:
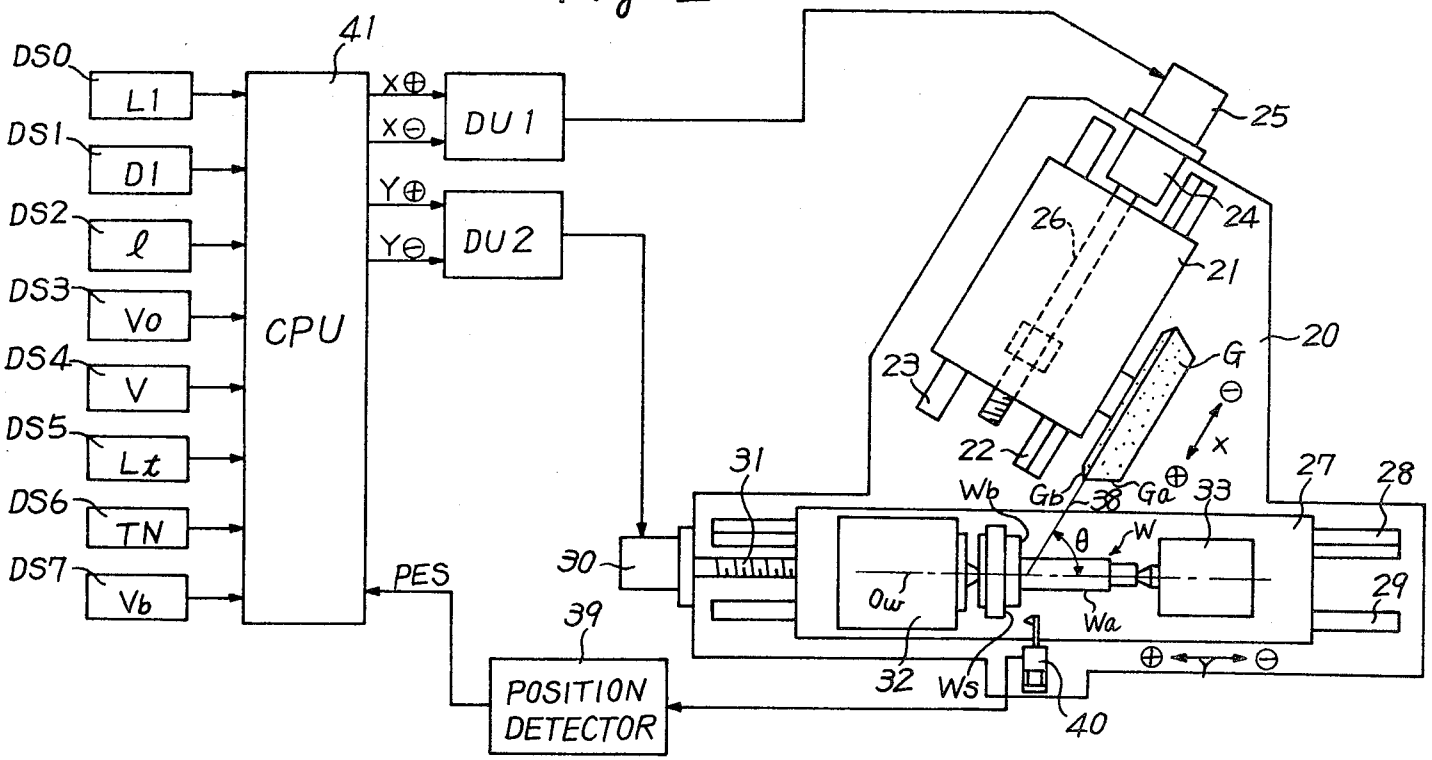
FIG. 2 is a plan view of a grinding machine connected to a control circuit therefor for performing a first method of shoulder grinding according to the present invention.

Referring now to the drawings, wherein like reference numerals or characters refer to identical or corresponding parts throughout the several views, and more particularly to FIG. 2, there is shown a bed 20 of a grinding machine. A wheel head 21, rotatably carrying a grinding wheel G made of cubic boron nitride, is slidably mounted on the bed 20 through a pair of guide ways 22 and 23. The grinding wheel G is rotated by a drive motor, not shown, in a usual manner. The wheel head 21 is threadedly engaged with a feed screw shaft 26 which is drivingly connected to a pulse motor 25 through a gearing mechanism 24.

A work table 27 is mounted on the front portion of the bed 20 to be slidable along a Y-axis direction through a pair of guide ways 28 and 29. The work table 27 is threadedly engaged with a feed screw shaft 31 which is drivingly connected to a pulse motor 30. A headstock 32 and a tailstock 33 are mounted on the work table 27 to rotatably support a workpiece W having a cylindrical portion Wa and a shoulder portion Wb adjacent and perpendicular to the cylindrical portion Wa. The workpiece W is rotated by a drive motor, not shown, in a usual manner. The axis Ow of the workpiece W is parallel to the pair of guide ways 28 and 29 and makes an acute angle $\theta$ with a path 38 of the grinding wheel G along an X-axis direction.

Figure 3:
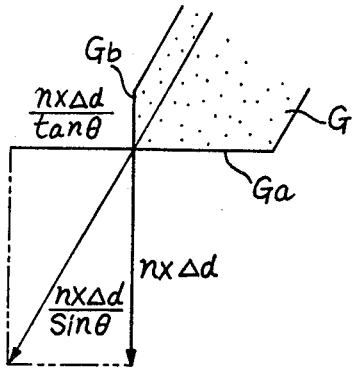
FIG. 3 shows a movement amount of a grinding wheel G shown in FIG. 2.

The grinding wheel G is formed at its periphery with a first grinding or face surface Ga for grinding the axially extending cylindrical portion Wa of the workpiece W and a second grinding or edge surface Gb for grinding the radially extending shoulder portion Wb of the workpiece W. The cylindrical portion Wa has an axial dimension larger than the first grinding surface Ga of the grinding wheel G. The shoulder portion Wb has a radial dimension larger than the second grinding surface Gb of the grinding wheel G. Since the path 38 of the grinding wheel G extends at an acute angle $\theta$ to the axis Ow of the workpiece W, movement of the grinding wheel G along the path 38 through an amount L causes the first grinding surface Ga to move through an amount $L \times \sin\theta$ in a direction perpendicular to the axis Ow of the workpiece W, which thus necessitates calculation of the radial movement amount of the first grinding surface Ga. According to the present invention, in order to avoid such calculation, gearing ratio of the gearing mechanism 24 is determined in such a manner that when pulses corresponding in number to an amount n are applied to the pulse motor 25, the grinding wheel G is moved along the path 38 through an amount $(n \times \Delta d)/\sin\theta$, where $\Delta d$ is a unit amount, and the first grinding surface Ga is moved through an amount $n \times \Delta d$ in a direction perpendicular to the axis Ow of the workpiece W, as shown in FIG. 3.

On the bed 20 is mounted a measuring head 40 which is adapted to engage with a reference end surface Ws of the workpiece W to indicate the position of the workpiece W in the Y-axis direction. A position detecting circuit 39 is connected to the measuring head 40 to receive therefrom the signal indicative of the position of the workpiece W so as to locate the workpiece W to a predetermined reference position in the Y-axis direction. The detecting circuit 39 applies a positioning completion signal PES to a central data processor 41, described later, when the workpiece W is located at the reference position.

Description is now made on a control device for grinding the workpiece W with the above-described grinding machine.

The central data processor 41 (referred to as CPU) is constituted by a small digital data processing device such as a so-called "microcomputer" and is connected to a plurality of digital switches DS0 to DS7 to receive various data required for grinding the workpiece W and to drive units DU1 and DU2 for distributing pulses thereto to drive the pulse motors 25 and 30.

Figure 4:
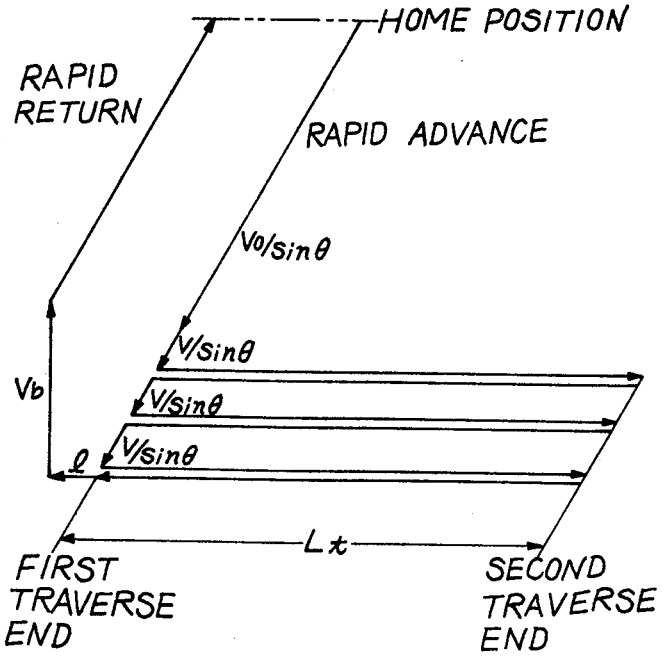
FIG. 4 shows a grinding cycle according to the first method of shoulder grinding.

The CPU 41 executes programs stored in a memory contained therein, not shown, to perform a grinding cycle shown in FIG. 4. According to the present invention, the wheel head 21 is moved along the path 38 to feed the first grinding surface Ga through an amount V preset in the digital switch DS4 toward and perpendicularly to the axis Ow of the workpiece W at a first traverse end (rightward movement end of the work table 27), and the work table 27 is moved to the left into a second traverse end (leftward movement end of the work table 27) through an amount Lt preset in the digital switch DS5 and then reversely moved into the first traverse end to traverse grind the cylindrical portion Wa of the workpiece W. This traverse grinding operation is repeated by a number of times TN preset in the digital switch DS6. When the traverse grinding operation on the cylindrical portion Wa of the workpiece W is completed, the work table 27 is moved to the right through an amount l preset in the digital switch DS2 from the first traverse end to feed the second grinding surface Gb into the radially inner portion of the shoulder portion Wb of the workpiece W. Thereafter, the wheel head 21 and the work table 27 are relatively moved to retract the grinding wheel G perpendicularly to the axis Ow of the workpiece W to thereby grind the shoulder portion Wb of the workpiece W from the radially inner portion to the radially outer portion.

Figure 5:
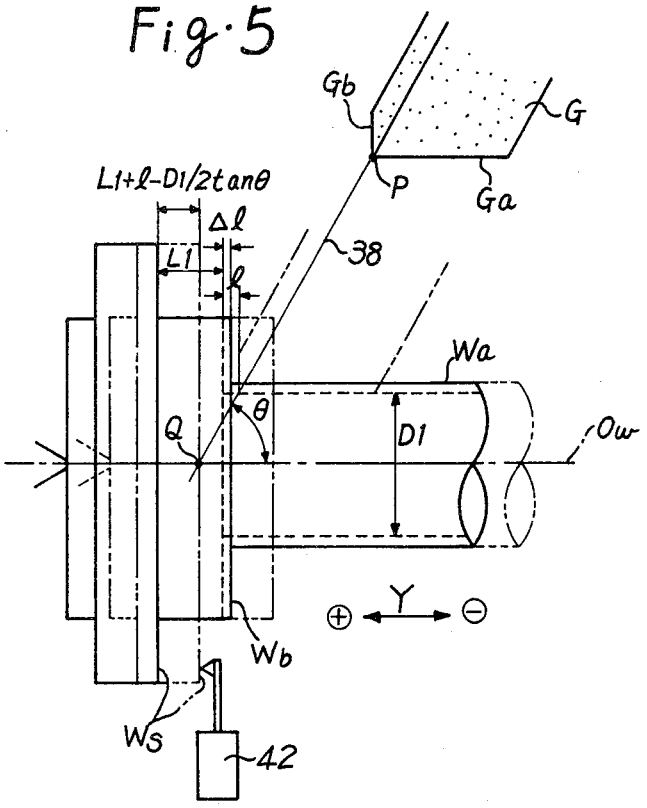
FIG. 5 shows a positional relationship between a workpiece W and the grinding wheel G when the workpiece W is located at a first traverse end as shown in FIG. 2.

According to the present invention, in order to prevent interference of the second grinding surface Gb of the grinding wheel G with the shoulder portion Wb of the workpiece W during the traverse grinding operation on the cylindrical portion Wa, the first traverse end of the work table 27 is determined at such a position that the workpiece W is located at the position shown in solid lines in FIG. 5. For this purpose, the CPU 41 has functions to locate the work table 27 at a reference position where the intersection Q between the reference surface Ws and the axis Ow of the workpiece W intersects with the path 38 and then to locate the work table 27 at the first traverse end by moving the work table 27 to the left ($\oplus$Y direction) from this reference position through an amount $L1+l-(D1/2 \times \tan\theta)$, where L1 is a distance between the reference surface Ws and the finished shoulder portion Wb and preset in the digital switch DS0; l is a distance larger by a predetermined amount than a stock removal $\Delta l$ for the shoulder portion Wb and preset in the digital switch DS2; and D1 is a finish dimension in diameter of the cylindrical portion Wa and preset in the digital switch DS1.

Figure 6A:
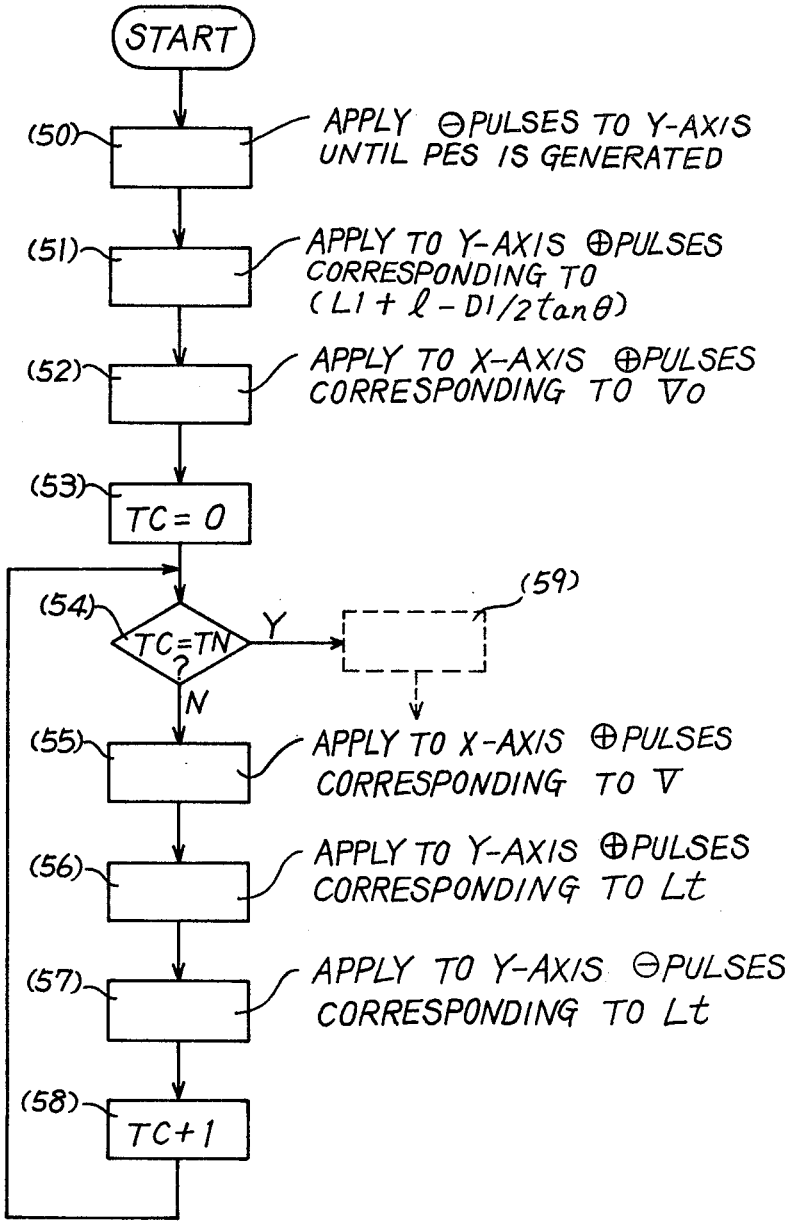
FIGS. 6A and 6B are a flow chart illustrating an operation of a central data processor 41 shown in FIG. 2.

The operation of the CPU 41 is now described with reference to the flow chart shown in FIGS. 6A and 6B. When a start switch, not shown, is depressed with the work table 27 supporting the workpiece W being positioned as shown in FIG. 2, the CPU 41 distributes, in a step 50 in FIG. 6A, pulses to the drive unit DU2 to move the work table 27 to the right until the position detecting circuit 39 generates the positioning completion signal PES, so that the workpiece W is located at the reference position. The CPU 41 subsequently proceeds to a step 51, wherein the CPU 41 calculates the amount $L1+l-(D1/2\times\tan\theta)$ and distributes pulses of the number corresponding to the calculated amount to the drive unit DU2 to move the work table 27 to the left into the first traverse end.

When the work table 27 is located at the first traverse end, the CPU 41 proceeds to a step 52, wherein the CPU 41 applies to the drive unit DU1 pulses of the number corresponding to an amount V0 preset in the digital switch DS3 at a rapid feed frequency. Accordingly, the grinding wheel G is rapidly advanced along the path 38 through the amount $V0/\sin\theta$ so that the first grinding surface Ga is positioned at the rapid advanced end. Subsequently, in step 53, the CPU 41 resets a traverse counter TC contained therein, not shown, for counting a number of times of the traverse grinding operations, and then proceeds to a step 54.

The steps 54 to 58 are provided for traverse grinding the cylindrical portion Wa of the workpiece W. In step 54, the CPU 41 checks whether the content of the traverse counter TC is coincident with the amount TN preset in the digital switch DS6. If coincidence is not found in the step 54, the CPU 41 proceeds to the step 55, wherein the CPU 41 applies pulses to the drive unit DU1 for feeding the first grinding surface Ga toward the axis Ow of the workpiece W along the path 38 through the amount V preset in the digital switch DS4 in a direction perpendicular to the axis Ow. In step 56, the CPU 41 applies to the drive unit DU2 pulses corresponding to the amount Lt preset in the digital switch DS5 to move the work table 27 from the first traverse end to the second traverse end. In step 57, the CPU 41 applies to the drive unit DU2 pulses corresponding to the amount Lt to reversely move the work table 27 from the second traverse end to the first traverse end. In step 58, the content of the traverse counter TC is increased by one, and then the process is returned back to the step 54. In this manner, the traverse grinding operations are performed on the cylindrical portion Wa of the workpiece W as the same times as the amount TN. When the traverse grinding operation is completed, the process proceeds from the step 54 to a step 59 shown in FIG. 6B.

In step 59, the CPU 41 applies to the drive unit DU2 pulses corresponding to the amount l preset in the digital switch DS2 to move the work table 27 to the right through the amount l from the first traverse end. Accordingly, the second grinding surface Gb of the grinding wheel G is fed into the radially inner portion of the shoulder portion Wb by the grinding amount $\Delta l$ to grind the radially inner shoulder portion Wb. At this time, the work table 27 is moved at such a feed rate as not to produce burn mark on the ground shoulder portion Wb.

Figure 7:
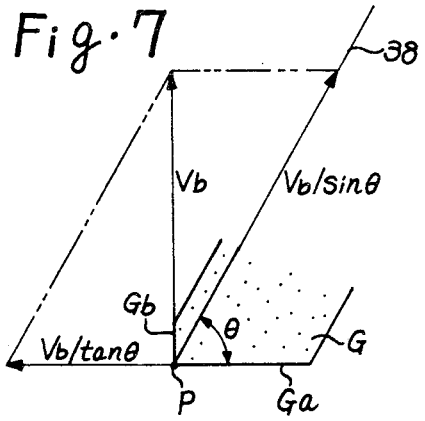
FIG. 7 shows a movement amount of the grinding wheel G and the workpiece W when the grinding wheel G is retracted away from and perpendicularly to the axis of the workpiece W.

After the second grinding surface Gb is fed into the inner shoulder portion Wb, the CPU 41 proceeds to a step 60, wherein control is made to relatively retract the grinding wheel G through an amount Vb preset in the digital switch DS7 in a direction perpendicular to the axis Ow of the workpiece W. To this end, it is necessary to retract the wheel head 21 through the amount $Vb/\sin\theta$ along the path 38 and simultaneously to move the work table 27 to the right through the amount $Vb/\tan\theta$, as shown in FIG. 7. As described hereinabove, according to the present invention, application of pulses corresponding in number to the amount Vb to the drive unit DU1 causes the wheel head 21 to move along the path 38 through the amount $Vb/\sin\theta$ by the aid of the gearing mechanism 24. Accordingly, the CPU 41 applies to the drive unit DU1 pulses corresponding to the amount Vb and simultaneously to the drive unit DU2 pulses corresponding to the amount $Vb/\tan\theta$ to thereby retract the grinding wheel G in a direction perpendicular to the axis Ow of the workpiece W.

Figure 6B:
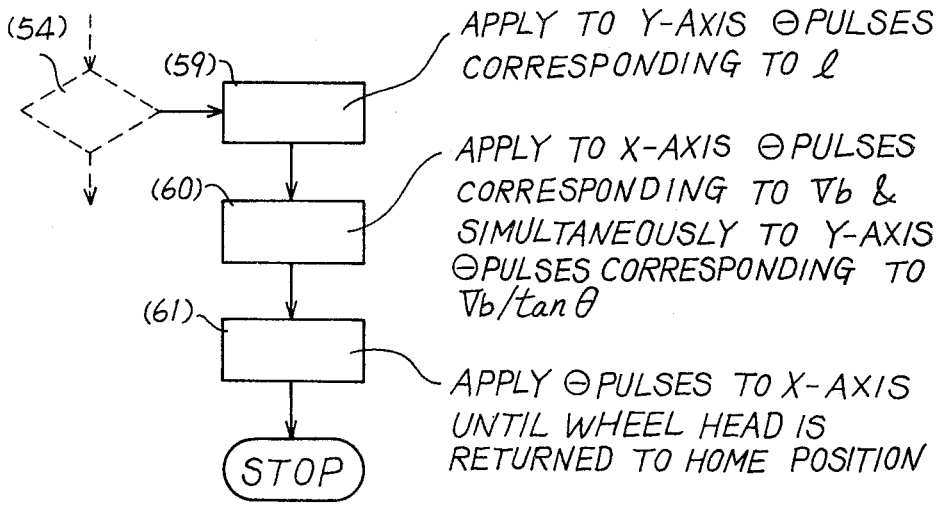
Figure 8:
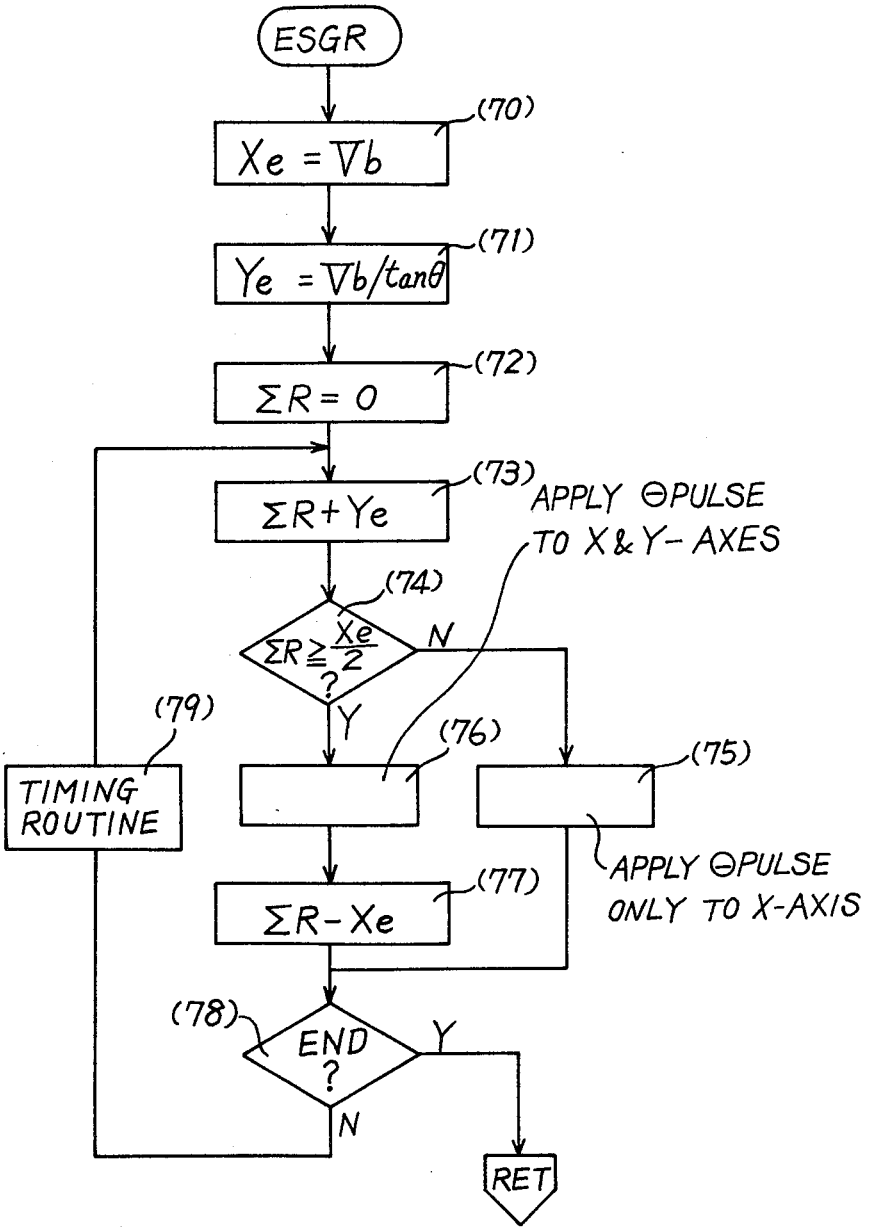
FIG. 8 is a flow chart illustrating an operation of the central data processor 41 for retracting the grinding wheel G in a direction perpendicular to the axis of the workpiece W.

FIG. 8 shows a flow chart of one example of the pulse distribution method applicable to retract the grinding wheel G in a direction perpendicular to the axis Ow of the workpiece W, as shown in the step 60 in FIG. 6B. In steps 70 and 71, the displacement amounts Vb and $Vb/\tan\theta$ of the grinding wheel G and the work table 27 are respectively set in registers Xe and Ye contained in the CPU 41, not shown. In step 72, a cumulative register $\Sigma R$ contained in the CPU 41, not shown, is cleared. In step 73, addition of the contents in the registers $\Sigma R$ and Ye is performed. In step 74, check is carried out as to whether an inequality $\Sigma R \geqq Xe/2$ is satisfied or not. If the inequality $\Sigma R \geqq Xe/2$ is not satisfied, one pulse is distributed to the drive unit DU1 to move the grinding wheel G in the $\ominus$X-direction in step 75 and then, the routine proceeds to a step 78. If the inequality is satisfied, one pulse is distributed to both of the drive units DU1 and DU2 in step 76 and then, calculation of $(\Sigma R-Xe)$ is performed in step 77. The routine then proceeds to the step 78, wherein check is performed as to whether or not pulses corresponding to the amount Vb is distributed to the drive unit DU1 in order to check the completion of pulse distribution. When the pulse distribution is completed, the routine is returned to the control routine shown in FIGS. 6A and 6B. When the pulse distribution is not completed, the routine is returned to the step 73 through a step 79 wherein a predetermined period of time elapses for timing purpose.

Accordingly, pulses are continuously distributed to the drive unit DU1 and pulses are intermittently distributed to the drive unit DU2, so that the grinding wheel G is retracted from the workpiece W in a direction perpendicular to the axis Ow of the workpiece W. Consequently, the shoulder portion Wb of the workpiece W is ground from the radially inner portion to the radially outer portion with high accuracy without causing the edge surface Gb around the intersection P of the grinding wheel G to wear out and to be made dull.

When the grinding operation on the shoulder portion Wb is completed, the wheel head 21 is retracted along the path 38 to the home position at a rapid speed to thereby complete one grinding cycle shown in FIG. 4.

Figure 9:
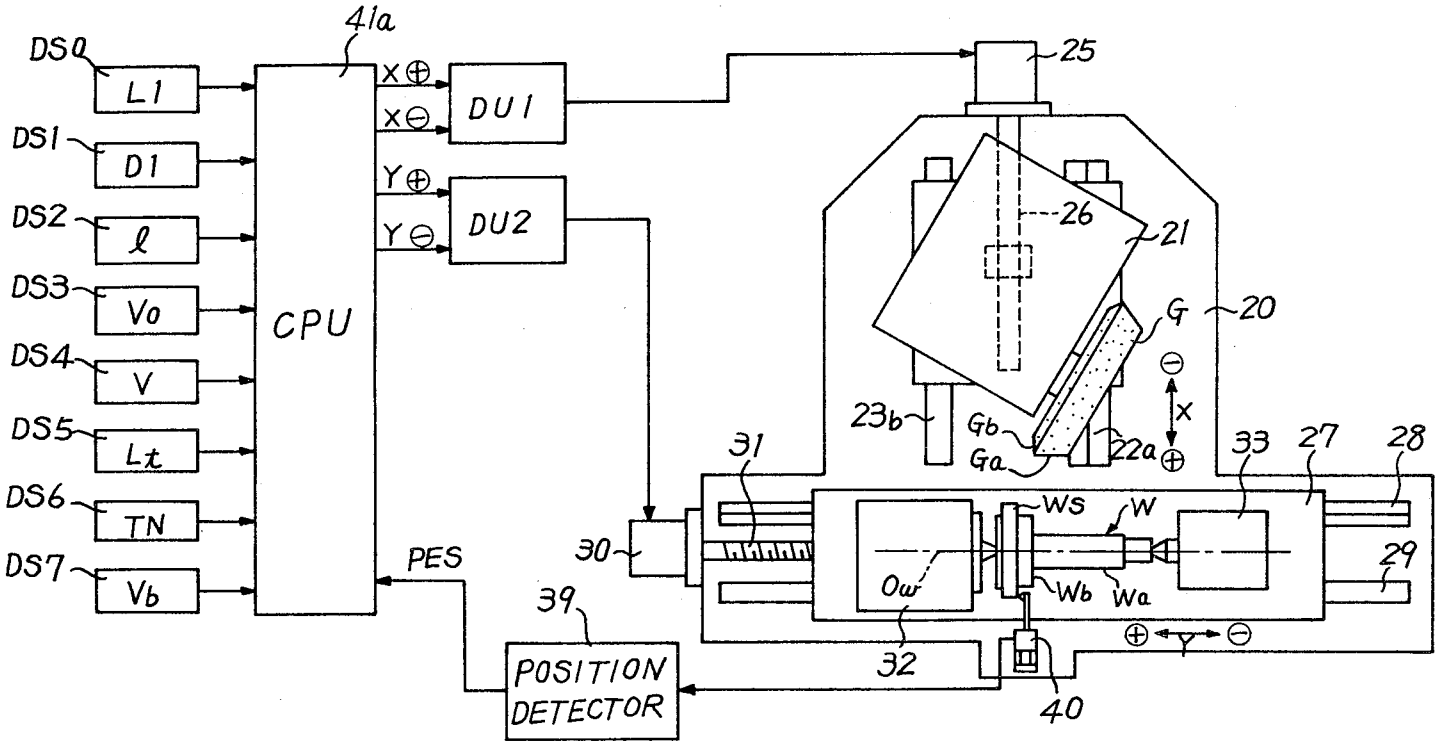
FIG. 9 is a plan view of a grinding machine connected to a control circuit therefor for performing a second method of shoulder grinding according to the present invention.
Figure 10:
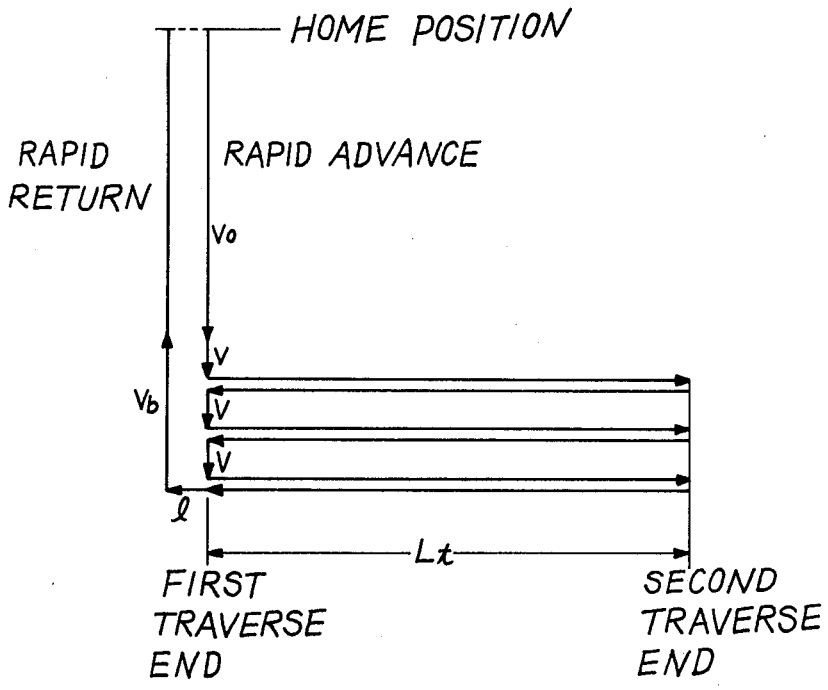
FIG. 10 shows a grinding cycle according to the second method of shoulder grinding.

FIG. 9 shows a second embodiment according to the present invention, wherein a wheel head 21 is mounted on a pair of guide ways **22*a* and 23*a* to be slidable in a direction perpendicular to the axis Ow of the workpiece W. The wheel head 21 rotatably carries a grinding wheel G whose axis extends at an acute angle to the axis Ow of the workpiece W. According to this second embodiment, there is no need to simultaneously distribute pulses to the two drive units in grinding the shoulder portion Wb, as in the first embodiment. As shown in FIG. 10, after the grinding wheel G is fed into the radially inner portion of the shoulder portion Wb from the first traverse end through the amount l, only the wheel head 21 is controlled to be retracted away from the axis Ow of the workpiece W. To this end, a CPU 41*a*** according to the second embodiment distributes pulses only to the drive unit DU1.

Figure 11:
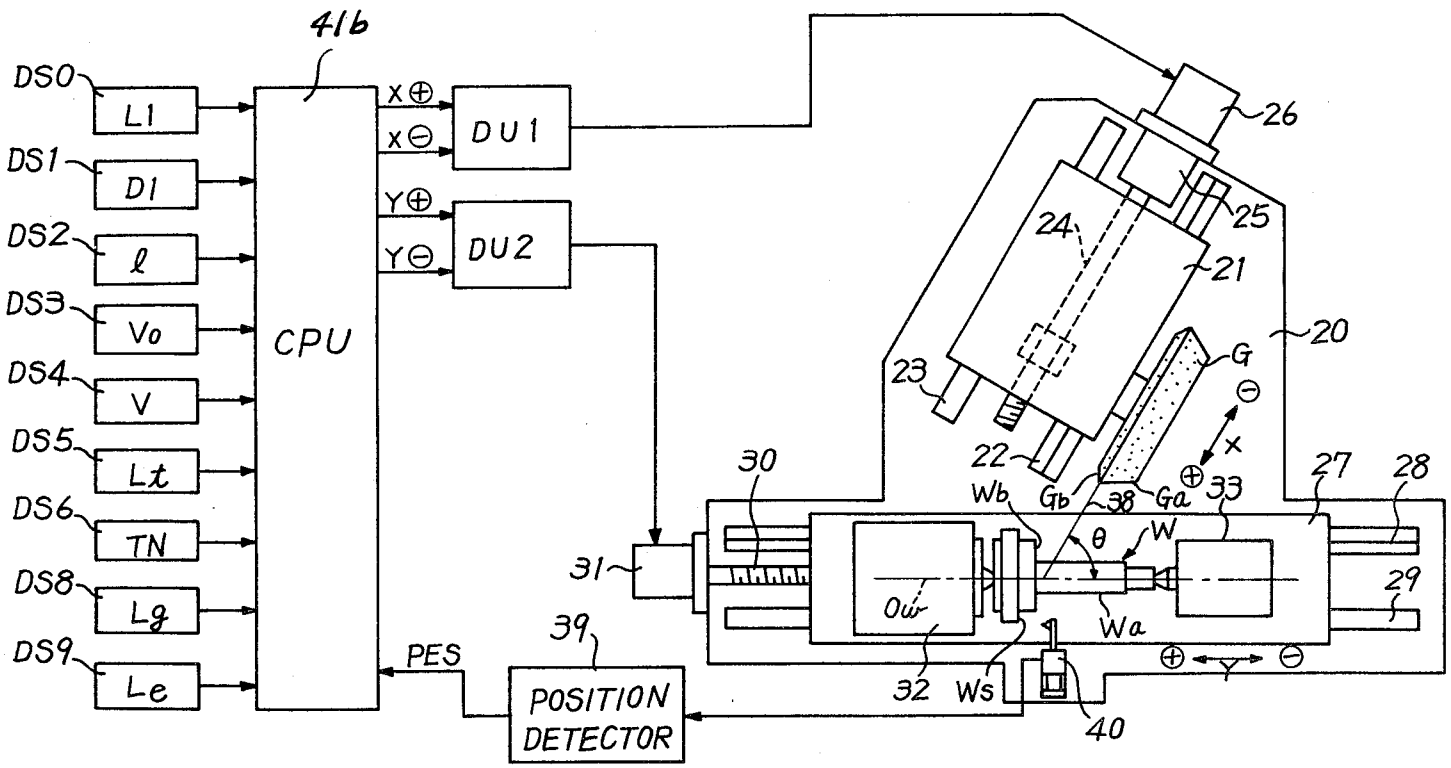
FIG. 11 is a plan view of a grinding machine connected to a control circuit therefor for performing a third method of shoulder grinding according to the present invention.
Figure 12:
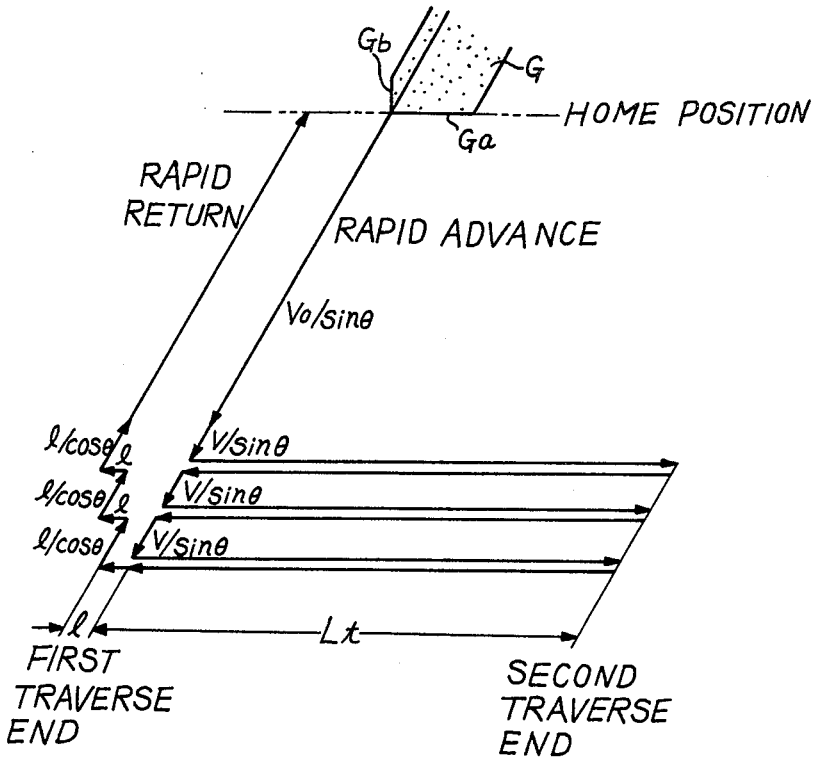
FIG. 12 shows a grinding cycle according to the third method of shoulder grinding.

FIG. 11 shows a third embodiment according to the present invention, which is different from the first embodiment in that a CPU 41*b* is connected to digital switches DS8 and DS9 in addition to the digital switches DS0 to DS6. The CPU 41*b* executes programs stored in a memory contained therein, not shown, to perform a grinding cycle shown in FIG. 12.

Figure 13:
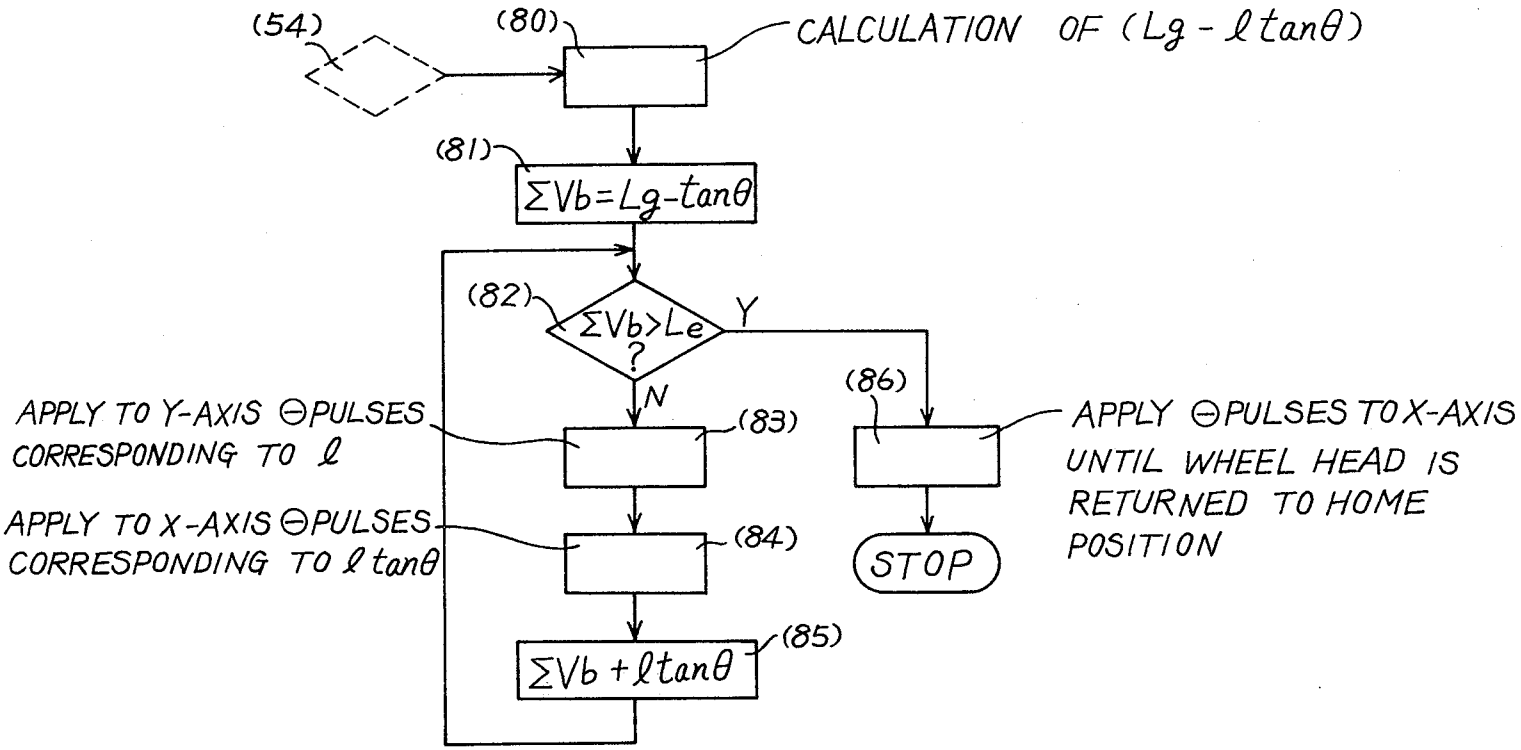
FIG. 13 is a flow chart illustrating an operation of a central data processor 41*b* for performing a portion of the grinding cycle shown in FIG. 12.

The operation of the CPU 41*b* is described with reference to the flow chart shown in FIGS. 6A and 13. When a start switch, not shown, is depressed with the work table 27 supporting the workpiece W being positioned as shown in FIG. 11, the CPU 41*b* operates, in accordance with the flow chart shown in FIG. 6A, to locate the workpiece W at the reference position in step 50 and subsequently to locate the work table 27 to the first traverse end in step 52, to rapidly advance the grinding wheel G to its rapid advanced end in step 52 and to reset the traverse counter TC in step 53, as in the first embodiment. The CPU 41*b* also operates to perform traverse grinding operations on the cylindrical portion Wa of the workpiece W from step 54 to step 58, as in the first embodiment. When the traverse grinding operation is completed, the process proceeds from the step 54 shown in FIG. 6A to a step 80 shown in FIG. 13.

Figure 14:
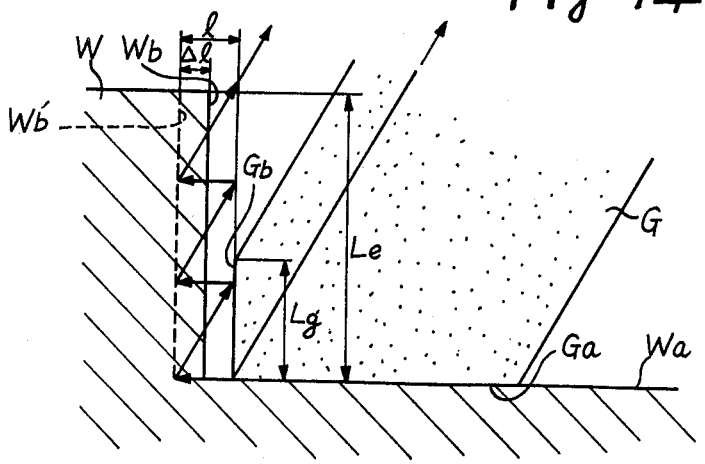
FIG. 14 is a schematic illustration showing movement of the grinding wheel G for shoulder grinding according to the third method.

In steps 80 to 85, movement of the work table 27 to the right and movement of the grinding wheel G away from the axis Ow of the workpiece W are alternately repeated to grind the shoulder portion Wb from the radially inner portion to the radially outer portion. According to this third embodiment, as shown in FIG. 14, the grinding wheel G is retracted away from engagement with the finished shoulder surface Wb' to a position where the second grinding surface Gb of the grinding wheel G is distanced by a predetermined amount l from the finished shoulder surface Wb' so as to move the second grinding surface Gb in a direction radially and outwardly of the axis Ow of the workpiece W. To this end, it is necessary to retract the grinding wheel G along the path 38 through the amount $l/\cos\theta$. Because of the arrangement of the gearing mechanism 24, the CPU 41*b* distributes to the drive unit DU1 pulses corresponding to the amount $l\times\tan\theta$.

In step 80, calculation of $(Lg-l\tan\theta)$ is carried out, where Lg is the width of the second grinding surface Gb of the grinding wheel G, as shown in FIG. 14 and preset in the digital switch DS8. This calculated result is preset in a register $\Sigma Vb$ contained in the CPU 41*b*, not shown, in step 81. In step 82, check is made as to whether inequality $\Sigma Vb>Le$ is satisfied or not, where Le is a radial dimension of the shoulder portion Wb, as shown in FIG. 14 and preset in the digital switch DS9. If the inequality $\Sigma Vb>Le$ is not satisfied, the CPU 41*b* distributes, in step 83, to the drive unit DU2 pulses corresponding to the amount l to move the work table 27 to the right to thereby grind the radially inner portion of the shoulder portion Wb through the grinding amount $\Delta l$ by the second grinding surface Gb of the grinding wheel G. In step 84, the CPU 41*b* subsequently distributes to the drive unit DU1 pulses corresponding to the amount $l\times\tan\theta$ to retract the grinding wheel G along the path 38 through the amount $l/\cos\theta$. In step 85, addition of $\Sigma Vb$ and $l\times\tan\theta$ is carried out. The operations in steps 83 to 85 are repeated to grind the shoulder portion Wb from the radially inner portion to the radially outer portion, until the inequality $\Sigma Vb>Le$ is satisfied in step 82. When the inequality is found to be satisfied in step 82, the process proceeds to a step 86, wherein the CPU 41*b* distributes pulses to the drive unit DU1 to retract the grinding wheel G along the path 38 to the home position at a rapid speed, to thereby complete one grinding cycle shown in FIG. 12.

Obviously, numerous modifications and variations of the present invention are possible in light of the above teachings. It is to be understood, therefore, that within the scope of the appended claims, the invention may be precticed otherwise than as specifically described herein.

What is claimed is:

1. A method of grinding a shoulder portion of a workpiece comprising the steps of:

rotating the workpiece about a first axis;

providing a grinding wheel having a grinding surface whose width is smaller than the shoulder portion of the workpiece for use in grinding the shoulder portion;

rotating the grinding wheel about a second axis extending at an acute angle to the first axis;

effecting first relative movement between the rotating grinding wheel and the rotating workpiece to engage the grinding surface of the grinding wheel with the radially inner portion of the shoulder portion; and effecting second relative movement between the rotating grinding wheel and the rotating workpiece to move the grinding surface of the grinding wheel in a direction away from the first axis to grind the shoulder portion from the radially inner portion to the radially outer portion thereof by the grinding surface of the grinding wheel.

2. A method as set forth in claim 1, wherein said step of effecting the second relative movement includes:

moving the grinding wheel away from the first axis along a path extending at an acute angle to the first axis; and moving the workpiece along the first axis simultaneously with the movement of the grinding wheel.

3. A method as set forth in claim 1, wherein said step of effecting the second relative movement includes:

moving the grinding wheel in a direction perpendicular to and away from the first axis.

4. A method as set forth in claim 1, wherein said step of effecting the second relative movement includes:

moving the grinding wheel away from the first axis along a path extending at an acute angle to the first axis through a predetermined distance;

moving the workpiece along the first axis through a distance which is equal to the predetermined distance multiplied by the cosine of the acute angle between the path and the first axis; and repeating the above-mentioned two steps through a predetermined number of times.

* * * * *